United States Patent [19]

Peterson et al.

[11] 4,110,194

[45] Aug. 29, 1978

[54] PROCESS AND APPARATUS FOR EXTRACTING BITUMINOUS OIL FROM TAR SANDS

[75] Inventors: Glenn R. Peterson, Idaho Falls; Marvin C. Hicks, Shelley; Peter W. Schwartz, Idaho Falls, all of Id.

[73] Assignee: Intermountain Oil Research, Inc., Idaho Falls, Id.

[21] Appl. No.: 677,523

[22] Filed: Apr. 16, 1976

[51] Int. Cl.[2] ..... C10G 1/04

[52] U.S. Cl. ..... 208/11 LE; 196/14.52

[58] Field of Search ..... 208/11 LE; 196/14.52

[56] References Cited

U.S. PATENT DOCUMENTS

| | | | |
|---|---|---|---|
| 2,885,339 | 5/1959 | Coulson et al. | 208/11 LE |
| 3,017,342 | 1/1962 | Bulat et al. | 208/11 LE |
| 3,041,267 | 6/1962 | Frame et al. | 208/11 LE |
| 3,547,803 | 12/1970 | Barkman et al. | 208/11 LE |
| 3,553,099 | 1/1971 | Savage et al. | 208/11 LE |

*Primary Examiner*—Delbert E. Gantz
*Assistant Examiner*—James W. Hellwege
*Attorney, Agent, or Firm*—Mallinckrodt & Mallinckrodt

[57] ABSTRACT

Tar sands are put into finely divided form, preferably by pressing them into sheets and flaking the sheets. The flakes are mixed with a solvent for the contained oils for a time sufficient to extract the oils. The resulting slurry is introduced beneath the surface of a body of water and the solids allowed to settle, while the solvent containing the oil rises to the top to form a liquid phase above the surface of the body of water. The wet solids and the oil-containing solvent are separately removed. After the oil is recovered from the solvent, as by fractional distillation, the solvent is recycled in the process, which is preferably carried on as a continuous operation.

15 Claims, 3 Drawing Figures

PROCESS AND APPARATUS FOR EXTRACTING BITUMINOUS OIL FROM TAR SANDS

BACKGOUND OF THE INVENTION

1. Field

This invention relates to processes for producing liquid oils from tar sands and bituminous shales.

2. State of the Art

Various methods have been proposed for separating bituminous oils from mineral materials containing same. Attempts have been made in the past to recover the oil from such bituminous-oil-bearing mineral materials as tar sands by heating the tar sands and then centrifuging the oil therefrom. It has also been suggested to subject the tar sands to sonic waves to aid in the release of the oil therefrom. These processes, however, have been found to be expensive and generally inefficient.

The most successful of the previous methods of separating the oil from the oil-bearing mineral materials have involved mixing the materials with water followed by separation of the solid particles of the mineral material from the oil-water emulsion. Two principal methods have been developed, the so-called "cold-water" method and the "hot-water" method.

In the "cold-water" method, a diluent, such as kerosene, is mixed with the oil-bearing mineral materials to increase the fluidity of the oil contained therein and to reduce its density below that of water. The mixture of mineral materials and diluent is passed through a mill or crusher where lumps are broken down, and the diluent is thoroughly mixed with the bituminous oil contained in the mineral materials. A large volume of water is then added to the mineral materials, and the water and mineral materials are thoroughly agitated. The bituminous oil separates from the solid mineral materials, and an oil froth or emulsion forms. The oil froth floats to the top of the water and is recovered. The operation is carried out at a temperature of 77° F. This temperature is critical and must be maintained for efficient extraction of the oil from the mineral materials. The oil froth which is recovered contains about 30% water in addition to the bituminous oil and diluent. The water separation and classification step is slow and is not readily adapted to continuous operation.

In the "hot-water" method, the oil-bearing mineral materials are subjected to a jet of high pressure steam and then introduced into a mixing vessel containing hot water, the temperature of which is maintained at about the boiling point. Low pressure steam is jetted into the mixture in the mixing vessel, and the heat and agitation produces a froth of oil, water, and air which accumulates above the level of the water in the tank. The froth contains about 30% water, together with substantial amounts of solids comprising fine sands and clay from the mineral materials. As with the "cold-water" method, the process is slow and is not readily adapted to continuous operation. The heat requirements are large, and because of the considerable amount of water in the froth, it must be dehydrated, thus necessitating additional operation steps, heat, and equipment.

An improvement in the "cold-water" method is disclosed in U.S. Pat. No. 2,825,677. As in the conventional "cold-water" method, a diluent or solvent for the bituminous oil is added to the tar or oil sand which is to be treated. The sand containing the added diluent is then introduced into a large volume of water, and the mixture is thoroughly agitated. The resulting slurry is subjected to centrifugal force, such force being maintained for sufficient duration to effect a separation by densities of sand, a water phase, and an organic phase containing the bituminous oil and diluent.

An improvement in the "hot-water" method is disclosed in U.S. Pat. No. 3,509,037. According to this reference, oil sand is mixed with super-heated water and a solvent such as kerosene. A portion of the water is then allowed to vaporize into steam to form a froth containing oil. The froth layer is separated from the sand and water, and the oil contained therein is recovered.

Several processes in which organic solvents are used to extract bituminous oils from materials containing same have been disclosed in the patent literature. As disclosed in U.S. Pat. No. 3,392,105, comminuted oil sands are mixed with a soluble oil (defined as nonpolar solvents containing a surfactant so as to have the ability to emulsify water when admixed therewith) to form a slurry. The viscosity of the slurry is decreased by mixing therewith a solvent which has a lower viscosity than the soluble oil. The sand is then separated from the mixture, and the low viscosity solvent is distilled therefrom.

Subjecting tar sands to acoustic vibrations during extraction of same with an organic solvent has been found to increase the amount of oil which can be recovered by the solvent extraction step. According to U.S. Pat. No. 3,017,342, the oil-bearing mineral material is premixed with a solvent capable of dissolving the oil contained therein. The premixed material is allowed to free fall through a body of the same solvent and then through a body of water. Both the bodies of solvent and of water are subjected to acoustic vibrations as the material falls therethrough. Advantageously, the body of solvent forms a separate liquid phase on the surface of the body of water so that the premixed material falls first through the solvent phase and then through the water phase.

U.S. Pat. No. 2,903,407 discloses a process for recovering bituminous oil from tar sands using a sodium silicate-hydrocarbon solvent solution to extract the oil from the tar sands at elevated temperatures. The hydrocarbon solvent solution is mixed with the tar sands in a rotary mixer. The mixing is continued for a period of between about 12 minutes to 2 hours, preferably about 1.5 hours. The mixture is then introduced into a separator-settling zone containing a body of aqueous soldium silicate, and an oil layer forms on the surface of the aqueous phase.

SUMMARY OF THE INVENTION

In accordance with the invention, mineral materials containing bituminous oil in one form or in another are intimately mixed with a hydrocarbon solvent which has a specific gravity less than that of water and which is capable of dissolving the bituminous oil contained in the mineral materials. The mixing is continued for a time sufficient for the solvent to extract essentially all the bituminous oil from the mineral materials, thereby forming a slurry which comprises solid particles of the mineral material suspended in the oil-rich solvent.

The oil-rich solvent is then separated from the solid particles of mineral material by feeding the slurry into a body of water beneath the surface thereof. Preferably, a stream of the slurry is continuously introduced into the body of water through a distributor means positioned wholly beneath the surface of the water. The distributor means is adapted to direct the incoming slurry downwardly into the water. The solid particles of mineral material contained in the slurry settle to the bottom of the body of water, and the oil-rich solvent rises and forms a supernatant layer on the surface of the body of water. Introducing the slurry stream beneath the surface of the water has been found to be particularly advantageous in obtaining a rapid, efficient separation of the solid particles of mineral material from the oil-rich solvent.

The solid particles of mineral material settle to the bottom of the body of water and are removed by a mud pump, auger, or other mechanism capable of transporting a dense slurry of the particulate material from the body of water. Water is continuously added to the body of the water to replace that which is withdrawn with the wet mineral material. The oil-rich solvent is skimmed from the surface of the body of water, and the bituminous oils are recovered therefrom.

The separation of the oil-rich solvent from the solid particles of mineral material is particularly effective when the slurry stream is introduced into the body of water through a distributor member which comprises a hollow cone having an upwardly directed apex, a downwardly directed, open base, and a plurality of openings through the sidewalls thereof. The slurry is jetted downwardly from the apex of the distributor, and as the hydrocarbon solvent phase separates from the particulate mineral material, it rises to the top of the body of water through the openings in the sidewalls of the distributor. The gradual reversal of the direction of flow of the oil-rich solvent, from its initial downward flow as it is introduced into the body of water to its ascent through the body of water, has been found to have a pronounced, beneficial effect on the rate of separation of the particulate material from the solvent, as well as on the efficiency of the separation. In accordance with the invention, the oil-rich solvent which is removed from the surface of the body of water contains only very small amounts of solid particles of mineral material in the form of fines. The fines can be removed from the oil-rich solvent by conventional filtration and/or by centrifugal separation.

It has also been found advantageous to utilize high speed mixing of the oil-bearing mineral materials and the hydrocarbon solvent. Preferably, the solvent and the mineral materials are mixed in a mixing vessel having an agitation impeller operating at a rotational speed of at least about 1200 revolutions per minute, with the tip speed of the impeller being from about 6000 to 9000 feet per minute. The high speed mixing results in very rapid extraction of the bituminous oil from the mineral materials. Essentially complete extraction is obtained with residence times as short as 30 seconds in the mixer. Because of the high speed mixing and rapid extraction of bituminous oil from the mineral materials, the process is adapted to an integrated, continuous mode of operation.

In continuous operation, the oil-bearing mineral materials and the hydrocarbon solvent are added continuously to the mixing vessel, and a stream of resulting slurry is withdrawn continuously from the mixing vessel and forwarded to separator apparatus for the underwater separation of the oil-rich solvent from the particulate material. It has been found that the slurry should be pumped directly from the mixer to the separator apparatus. If the slurry is allowed to stand, even for only a short time interval, the particulate mineral matter in the slurry tends to settle and form a dense mass which clogs pumps and associated piping.

The oil-bearing mineral materials being introduced into the mixing vessel are preferably crushed or otherwise treated prior to being introduced to the mixing vessel so as to eliminate large chunks or hard nodules from entering the mixing vessel. Advantageously, the oil-bearing mineral materials are pressed into a relatively thin sheet having a thickness of from about 3 to 15 mm, such as by passing the material between pressure rollers. In addition to breaking up large chunks etc., the pressing generates residual heat in the materials which render them more pliable. The thin sheet of material is then broken into flakes prior to being introduced into the mixing vessel.

THE DRAWINGS

An embodiment representing the best mode presently contemplated of carrying out the novel concepts of the invention in actual practice is illustrated in the accompanying drawings, in which:

FIG. 1 is a schematic diagram depicting the process as applied to continuously extracting bituminous oil from tar sands or other mineral materials containing such oil;

FIG. 2, a perspective view of mixing vessel with a portion of the sides being broken away to show the agitator therein; and FIG. 3, a perspective of underwater separator apparatus with a portion of its sides broken away to show internal details thereof.

DETAILED DESCRIPTION OF THE ILLUSTRATED EMBODIMENTS

Figure 1:
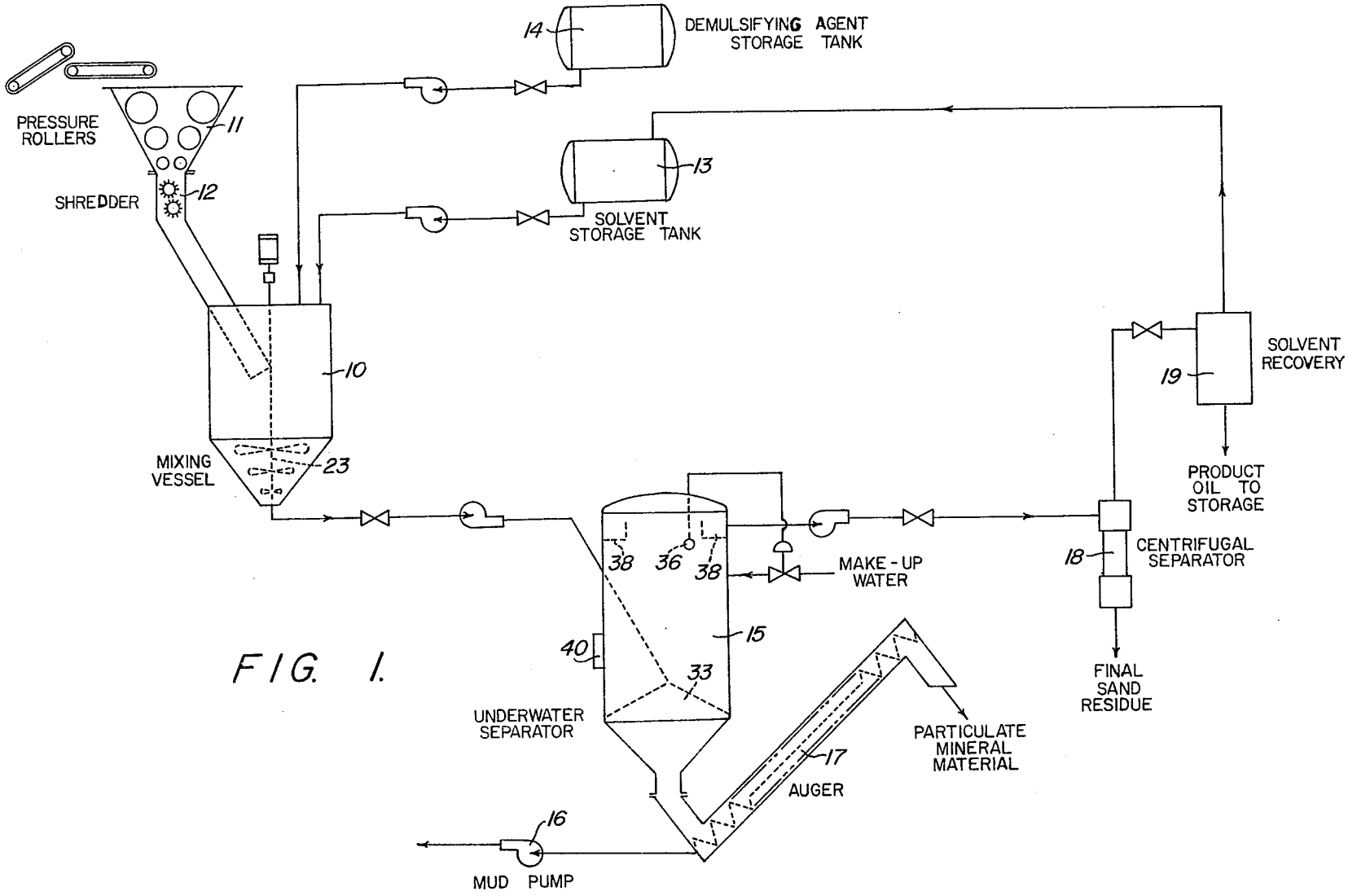

The best mode presently contemplated of carrying out the invention is illustrated schematically in FIG. 1. Mineral materials containing bituminous oil, i. e. tar sands and bituminous shales, are comminuted and continuously introduced into a mixing vessel 10. A hydrocarbon solvent which is capable of dissolving the bituminous oil contained in the mineral materials is also introduced into mixing vessel 10. The hydrocarbon solvent must have a specific gravity less than that of water. Suitable solvents which can be used include gasoline, kerosene, diesel oil, paint thinners, naphtha, benzene, toluene, xylene, mineral spirits, hexane, heptane, and halogenated hydrocarbon solvents such as carbon tetrachloride, trichloroethylene, perchloroethylene, and chlorinated benzenes.

It has been found advantageous to subject the mineral material to a compressive force prior to mixing it with the hydrocarbon solvent. Preferably, the mineral material is pressed into a thin sheet having a thickness of about 3 to 15 millimeters. The sheet of material is then broken into flakes prior to being introduced into the mixing vessel. As illustrated, the mineral material is fed, preferably as a comminuted aggregate containing particles having a maximum dimension of not over about 6 to 8 inches, to a set of pressure rollers 11. The rollers 11 comprise matched sets of rollers having an adjustable nip therebetween. Each set of rollers is driven so that one of the rollers thereof rotates clockwise and the other rotates counterclockwise. The sets of rollers are positioned one following the other with the nips of succeeding sets of rollers being smaller than the preceeding set.

The pressure rolling of the mineral materials breaks up any large chunks and hard nodules of material. The rolling also generates residual heat in the materials which render the thin sheets more pliable as well as more susceptible to the solvent extraction of the bituminous oil therefrom. A doctor blade is preferably used on each of the rolls of the pressure rollers to prevent any buildup of mineral materials on the surfaces thereof.

The thin sheet of material exiting from the pressure rollers is broken into flakes by pinbreaker shredder 12. Shredder 12 comprises a set of rolls having a plurality of pins extending radially from the surface thereof. The pinbreaker rolls are operated at a rotational speed sufficient to shred the thin sheet of material coming from the pressure rollers into small flakes.

The flakes of mineral material are fed continuously from the pinbreaker shredder 12 to the mixing vessel 10. Simultaneously, a hydrocarbon solvent is introduced into the mixing vessel 10 from the solvent storage tank 13. The solvent is fed to mixing vessel 10 at a rate of about one part solvent for every two to three parts of mineral materials. Throughout the specification and claims, unless otherwise noted, proportions are based on parts by weight.

It is also advantageous to add a demulsifying agent, such as those sold under the trademark Tretolite - No RP-2335-57-1, to the mixing vessel 10 at a rate of about one part per 20,000 parts of mineral materials. The demulsifying agent aids in obtaining a clean separation of the mineral particles and the oil-rich solvent in the subsequent separation step of the process. Although the demulsifying agent could be added to the system at any point up to the final separation of the mineral particles from the oil-rich solvent, it has been found most convenient to add it directly to the mixing vessel 10. As shown in FIG. 1, the demulsifying agent is fed to the mixing vessel 10 from the demulsifying agent storage tank 14.

The mixing vessel 10 is designed for very high speed mixing of the mineral materials and the hydrocarbon solvent, which results in rapid, efficient extraction of the bituminous oil from the mineral materials. The agitation impeller in the mixing vessel 10 operates with a rotational speed of at least about 1200 revolutions per minute. The tip speed of the impeller should be within the range of about 6,000 to about 9,000 feet per minute. The mineral materials and the hydrocarbon solvent are retained in the mixing vessel 10 for a time sufficient for the solvent to extract the bituminous oil from the mineral materials. When the starting mineral materials are pressed into a thin sheet and then broken into flakes prior to being introduced into the mixing vessel, the retention time necessary in the mixing vessel 10 for essentially complete extraction of the bituminous oils has been found to be about 30 seconds. Such a short retention time permits handling of large amounts of mineral materials with a minimum sized mixing vessel. For example, if the process is to have a capacity of treating 100 tons of mineral material per hour, the size of the mixing vessel would have to be sufficient to contain 1,667 pounds of mineral material and up to about 900 pounds of solvent. If the residence time in the mixing vessel were even 12 minutes (the minimum mixing time specified in U.S. Pat. No. 2,903,407, wherein the preferred mixing time was specified as 1.5 hours), the size of the mixing vessel would have to be sufficient to contain 40,000 pounds of mineral materials and up to 22,000 pounds of solvent. Thus, it can be seen that the high speed mixing of the present invention results in a remarkable reduction in the size of the mixing vessel for a given throughput of mineral materials.

Figure 2:
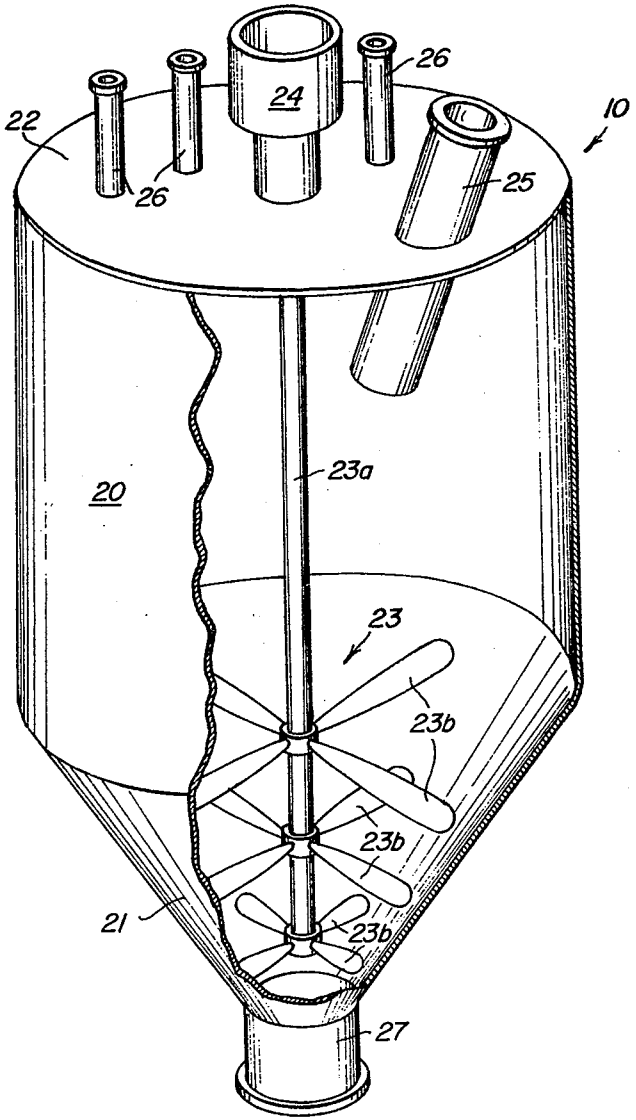

The mixing vessel 10 preferably comprises, as shown in FIG. 2, a cylindrical shaped portion 20 having a conical bottom 21 and a conventional top cover 22. An agitator 23 is provided in the vessel 10 so that its shaft **23*a* is essentially vertical and concentric with the cylindrical axis of the vessel 10. At least one set of impellers 23*b* are attached to the shaft 23*a* and positioned in an essentially horizontal plane within the conical shaped bottom portion 21 of vessel 10. It has been found advantageous to have at least two sets of impellers 23*b* being attached in spaced position along the common shaft 23*a*. The tip ends of each set of impellers extend radially from the shaft 23*a* to within close proximity of the sides of the conical shaped bottom 21. The shaft 23*a* is driven at rotational speed of at least 1200 rpm by an appropriate motor 24. The impellers 23*b*** are adapted to vigorously propel the particulate mineral materials and the hydrocarbon solvent upwardly therefrom, so that as the material is forced down by gravity, it is subjected to violent agitation.

As shown in FIG. 2, the top of the mixing vessel is provided with a plurality of nozzles through which the mineral materials, hydrocarbon solvent, and demulsifying agents are introduced thereinto. The larger nozzle 25 is used for introduction of the mineral materials, and the other nozzles 26 are used for introduction of the hydrocarbon solvent and demulsifying agents. The slurry that is produced in the mixing vessel 10 is withdrawn through a bottom nozzle 27 which is located at the apex of the conical shaped bottom 21 of the mixing vessel 10.

The slurry from the mixing vessel 10 is pumped directly to an underwater separator as shown diagramatically in FIG. 1. The slurry should not be allowed to stand in pipelines or in an unagitated holding tank due to the tendency of the particulate matter to settle into a dense mass which clogs vessel nozzles, pumps, and associated piping. The pump used to transport the slurry should, of course, be of the type designed to handle fluid suspensions of particulate, solid materials.

The slurry stream withdrawn from the mixing vessel 10 is introduced into a body of water contained in the underwater separator 15. The slurry is fed into the separator 15 beneath the surface of the water, preferably through a distributor means which is adapted to direct the incoming slurry downwardly into the water. Introducing the slurry stream downwardly into a body of water from a point beneath the surface thereof has been found to result in a particularly effective, rapid separation of the solid particles of mineral material from the oil-rich solvent. The gradual reversal of the direction of flow of the oil-rich solvent, from its initial downward flow as it is introduced into the body of water to its ascent through the body of water, has a pronounced beneficial effect on the rate of separation as well as on the efficiency of the separation.

The solid, particulate material, having a greater density than water, settles to the bottom of the body of water and is removed by a mud pump 16 and auger 17. The mud pump 16 is effective in removing the fine particles of material which tend to collect at the bottom of auger 17, while auger 17 is effective in removing the major portion of the particulate materials from the underwater separator 15. Water is added to the underwater separator 15 as needed to make up for the water content of the wet mineral materials removed by the mud pump 16 and auger 17.

The oil-rich solvent rises to the surface and forms a supernatant layer on the body of water in separator 15. The supernatant layer of oil-rich solvent is skimmed and removed from the top of separator 15. The particulate mineral materials removed from the bottom of the separator 15 have been found to contain very little solvent and essentially no bituminous oil. The amount of solvent contained in the particulate materials removed from separator 15 is consistently less than about 2% based on the weight of particulate mineral materials being removed.

Figure 3:
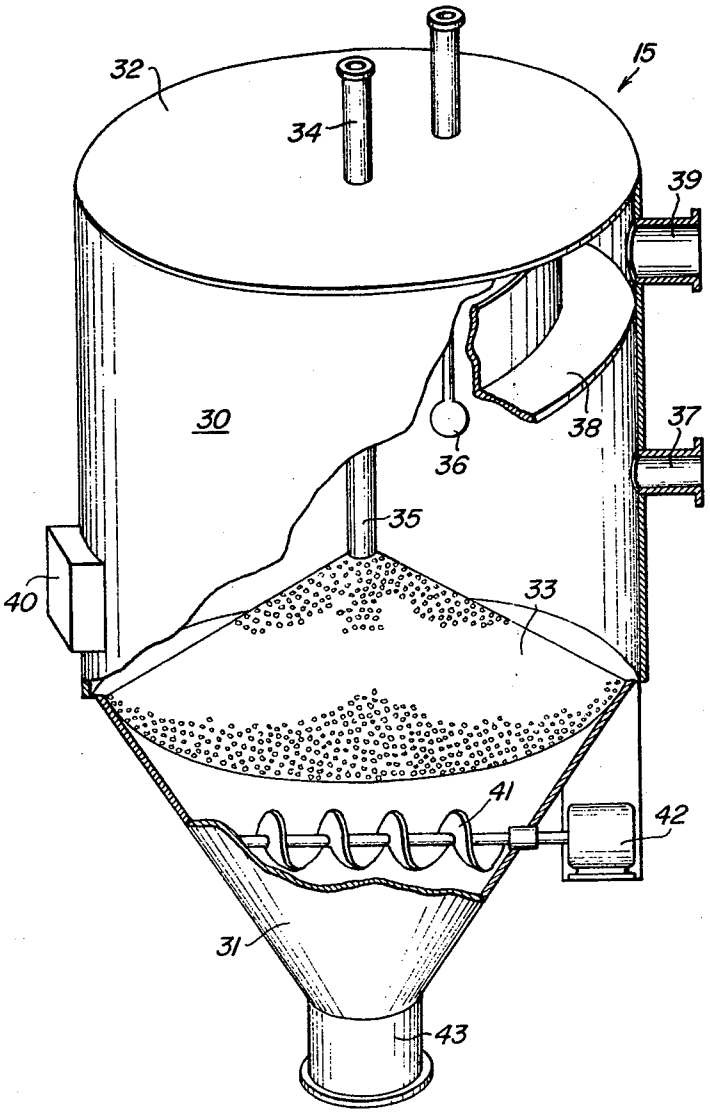

The separation of the oil-rich solvent from the particulate mineral materials has been found to be particularly effective when the slurry is introduced downwardly into the body of water from the apex of a hollow, cone-shaped distributor which is positioned beneath the surface of the body of water. A preferred form of the separator 15 incorporating the cone-shaped distributor is illustrated in FIG. 3. The separator 15 comprises a cylindrical portion 30 having a conical bottom 31 and a conventional cover 32. The hollow, cone-shaped distributor 33 is positioned within the cylindrical portion 30 so that it opens downwardly, i.e., the perimeter of the distributor 33 is below the apex of the cone. The apex is located concentric to the cylindrical axis of the separator 15. The distributor 33 is of such size as to cover at least 90% of the cross-sectional area of the cylindrical portion 30. Preferably, the distributor 33 is of such size and so positioned that its perimeter is adjacent the intersection of the cylindrical portion 30 and the bottom 31 of separator 15.

The conical surface of the distributor 33 has a plurality of openings therein which permit fluid communication between the portions of the separator 15 above and below the distributor 33. A pipe 35 extends from a feed nozzle 34 through the top of the separator 15 to the apex of the distributor. Slurry is fed through the pipe 35 and introduced downwardly into the body of water from the apex of the conical-shaped distributor 33. Means are provided for maintaining a preset level of water in the separator 15. As shown in the drawings, a differential float 36, which will float at the surface of the body of water, is positioned in the separator 15. The float 36 is then used to control the amount of make-up water which is introduced into separator 15 through a nozzle 37 in the side of the separator 15.

An internal "L" shaped flange 38 is positioned around the inside surface of the tank adjacent the top thereof. The flange 38 forms a catch basin for the overflow of oil-rich solvent. The oil-rich solvent is then withdrawn from such catch basin through nozzle 39 in the side of separator 15.

It has been found that subjecting the body of water used in separating the oil-rich solvent from the particulate mineral material to acoustic vibration aids in the separation. Thus, a device 40, which is capable of inducing acoustic vibrations in the body of water contained in separator 15 is installed on the side of separator 15. It has also been found advantageous to agitate the solid materials which collect at the bottom of the body of water to aid in separating the oil-rich solvent from the solid mineral materials, as well as to aid in removal of the solids from the bottom of the separator apparatus. As shown in FIG. 3, a helical screw agitator 41 is positioned in the conical shaped bottom of separator 15, and a motor 42 is provided to rotate agitator 41. A nozzle 43 is positioned at the bottom of separator 15 for withdrawing the settled mineral materials therefrom.

The oil-rich solvent which is skimmed and removed from separator 15 contains very small amounts of mineral material in the form of fines. The fines are preferably removed from the oil-rich solvent by subjecting the solvent to a filtration or centrifuging operation. As illustrated in FIG. 1, the oil-rich solvent is withdrawn from separator 15 and introduced into centrifugal separator 18. The final sand residue from the centrifugal separator 18 can be treated to recover the small amount of solvent and oil contained therein, or is otherwise discarded.

The oil-rich solvent from the centrifugal separator is forwarded to a solvent recovery area 19 wherein the bituminous oil is separated from the solvent. The separation can conveniently be accomplished by conventional distillation. The recovered solvent is recycled to the solvent storage tank 13, and the bituminous oil is forwarded to storage tanks.

Whereas there are here illustrated and described embodiments of process and apparatus presently contemplated as the best mode of carrying out the invention in actual practice, it is to be understood that various changes may be made without departing from the subject matters particularly pointed out and distinctly claimed hereinafter.

We claim:

1. A process for treating tar sands to recover the bituminous oil therefrom, comprising intimately mixing tar sands with a hydrocarbon solvent which has a specific gravity less than that of water and is capable of dissolving the bituminous oil contained in the tar sands; continuing said mixing for a time sufficient for the solvent to extract said bituminous oil from the tar sands, thereby producing a slurry of solid particles suspended in a solution of bituminous oil dissolved in said hydrocarbon solvent; feeding the slurry into a body of water beneath the surface thereof; allowing the solid particles in the slurry to settle to the bottom of the body of water and said solvent solution and dissolved bituminous oil to rise to the surface of the body of water to form a separate liquid phase above the surface of the body of water; removing water-wet solid particles from the bottom of the body of water; removing said solution of hydrocarbon solvent and dissolved bituminous oil from the surface of the body of water; and recovering the dissolved bituminous oil from the hydrocarbon solvent.

2. A process in accordance with claim 1, wherein the tar sands and hydrocarbon solvent are mixed in a mixing vessel having an agitation impeller operating at a speed of at least about 1200 revolutions per minute with the tip speed of the impeller being about 6000 to about 9000 feet per minute.

3. A process in accordance with claim 2, wherein the tar sands and hydrocarbon solvent are added continuously to the mixing vessel; a stream of the resulting slurry is withdrawn continuously from the mixing vessel and continuously fed to said body of water; the water-wet solid particles are removed continuously from the bottom of the body of water; water is continuously added to the body of water to maintain a substantially constant amount of water therein; and the solution of hydrocarbon solvent and dissolved bituminous oil is continuously skimmed from the surface of the body of water.

4. A process in accordance with claim 3, wherein the slurry withdrawn from the mixing vessel is introduced into the body of water by a distributor means which is wholly positioned beneath the surface of the water and which directs the slurry downwardly into the body of water.

5. A process in accordance with claim 4, wherein the distributor means comprises a hollow cone having an upwardly directed apex, a downwardly directed, open base, and a plurality of openings through the sidewall thereof; and wherein the slurry is jetted downwardly from the apex of said hollow cone so that the hydrocarbon solvent phase separates from the solid particles and rises to the top of the body of water through the side openings in the cone, and so that said solid particles settle to the bottom of the body of water.

6. A process in accordance with claim 5, wherein the distributor means covers at least 90% of the horizontal cross-sectional area of the body of water.

7. A process in accordance with claim 3, wherein the mixing vessel has a conical-shaped bottom portion; and the impeller is positioned in said bottom portion and is adapted to vigorously propel the slurry in the vessel upwardly therefrom.

8. A process in accordance with claim 7, wherein at least two agitation impellers are positioned in the conical shaped bottom portion of the mixing vessel, said impellers being mounted on a common shaft which is coincident with the axis of said bottom portion.

9. A process in accordance with claim 3, wherein the solution skimmed from the body of water is fed continuously to a centrifugal separator, whereby any fine solid particles contained in the skimmed solution are removed therefrom; the dissolved bituminous oil is recovered from the resulting solution; and the remaining solution, consisting essentially of hydrocarbon solvent, is recycled as feed to said mixing vessel.

10. A process in accordance with claim 3, wherein the tar sands is first pressed into a relatively thin sheet having a thickness of from about 3 to 15 mm, thereby crushing any coarse lumps and generating residual heat which renders said tar sands pliable; and the so-formed sheet of tar sands is then broken into flakes prior to being mixed with the hydrocarbon solvent.

11. A process in accordance with claim 10, wherein the tar sands is pressed into the relatively thin sheet by passing it between pressure rollers.

12. A process in accordance with claim 2, wherein a demulsifying agent is added to the hydrocarbon solvent to aid in separation of the solid particles from the solution of hydrocarbon solvent and bituminous oil in the body of water.

13. A process in accordance with claim 2, wherein the body of water is subjected to acoustic vibration to aid in separating the solid particles from the solution of hydrocarbon solvent and bituminous oil.

14. A process in accordance with claim 2, wherein the solid particles at the bottom of the body of water are subjected to mechanical agitation to aid in separating the solution of hydrocarbon solvent and bituminous oil therefrom.

15. A process in accordance with claim 1, wherein the slurry is introduced into the body of water by a distributor means which is positioned beneath the surface of the water and which directs the slurry downwardly into the body of water.

* * * * *